US010415840B2

(12) United States Patent
de Oliveira

(10) Patent No.: US 10,415,840 B2
(45) Date of Patent: Sep. 17, 2019

(54) STRUCTURAL ARRANGEMENT FOR AIR-CONDITIONER

(71) Applicant: Alcione Rodrigues de Oliveira, Porto Alegre (BR)

(72) Inventor: Alcione Rodrigues de Oliveira, Porto Alegre (BR)

( * ) Notice: Subject to any disclaimer, the term of this patent is extended or adjusted under 35 U.S.C. 154(b) by 0 days.

(21) Appl. No.: 15/276,453

(22) Filed: Sep. 26, 2016

(65) Prior Publication Data

US 2017/0234555 A1 Aug. 17, 2017

Related U.S. Application Data

(63) Continuation of application No. 14/371,698, filed as application No. PCT/BR2013/000027 on Jan. 23, 2013, now Pat. No. 9,453,650.

(30) Foreign Application Priority Data

Jan. 31, 2012 (BR) ..... 02012002194 U

(51) Int. Cl.

| | |
|---|---|
| ***B05B 3/10*** | (2006.01) |
| ***B01F 3/04*** | (2006.01) |
| ***F24F 6/12*** | (2006.01) |
| ***B05B 7/00*** | (2006.01) |
| ***B01F 5/18*** | (2006.01) |
| ***F24F 6/16*** | (2006.01) |
| ***F24F 6/06*** | (2006.01) |
| *F24F 5/00* | (2006.01) |
| *F24F 11/56* | (2018.01) |

(52) U.S. Cl.

CPC ..... *F24F 6/16* (2013.01); *B01F 3/04021* (2013.01); *B01F 3/04035* (2013.01); *B01F 3/04042* (2013.01); *B01F 5/18* (2013.01); *B05B 3/10* (2013.01); *B05B 3/1035* (2013.01); *B05B 7/0081* (2013.01); *F24F 6/06* (2013.01); *F24F 6/12* (2013.01); *B01F 2215/0091* (2013.01); *F24F 5/0035* (2013.01); *F24F 11/56* (2018.01)

(58) Field of Classification Search

CPC ..... F24F 6/12; F24F 6/06; F24F 6/16; B01F 3/04035; B01F 3/04042; B01F 5/18; B05B 3/10; B05B 3/1035; B05B 7/0081

See application file for complete search history.

(56) References Cited

U.S. PATENT DOCUMENTS 1,736,799 A * 11/1929 Planert ..... F24F 6/06 239/214

8,720,869 B2 * 5/2014 Zhang ..... B01D 47/08 261/118

* cited by examiner

*Primary Examiner* — Robert A Hopkins

(74) *Attorney, Agent, or Firm* — Papalas PLLC

(57) ABSTRACT

BUILDING FEATURE APPLIED IN AIR-CONDITIONING APPLIANCE, capable of enriching the air with atomized water droplets in two stages, where in a first moment the water sent directly from the water supply network is pre-atomized in an appliance (8); being then delivered to the main atomizer (9), which produces the final atomization, creating an ultrafine mist that facilitates the thermal exchange between the mist and the air. The air-conditioning appliance must be associated to a fan so as to spread this mist to the room.

13 Claims, 2 Drawing Sheets

STRUCTURAL ARRANGEMENT FOR AIR-CONDITIONER

RELATED APPLICATIONS

This application is a continuation of U.S. application Ser. No. 14/371,698, entitled "Building Feature Applied in Air Conditioning Appliance", filed 10 Jul. 2014, the disclosure of which is hereby incorporated herein by reference in its entirety, which is a U.S. filing under 371 of international PCT/BR2013/000027, filed on 23 Jan. 2013, the disclosure of which is hereby incorporated herein by reference in its entirety, which claims the benefit of Brazil Patent Application BR20 2012002194-9, filed on 31 Jan. 2012, the disclosure of which is hereby incorporated herein by reference in its entirety.

TECHNICAL FIELD

The following descriptive report for utility model concerns the development of an air conditioning appliance for rooms that is capable of enriching the air with droplets of atomized water in two stages, in which in a first moment the water directly coming from the water network is pre-atomized in a pre-atomizing gadget and then delivered to the main atomizer that produces the final atomization, creating a ultrafine mist that helps the thermal exchange between the mist and the air. The air conditioning appliance must come associated to a fan to spread this mist to the room.

STATE OF THE ART

The State of the Art of the air conditioning appliances work differently from the air conditioners. The main function of the air conditioning appliance is to improve the air quality of a room such as a bedroom, living-room or office.

Most of the air conditioning appliances may have three different functions, namely: heating the air, ventilating and humidifying.

Thus, the air conditioning appliance is an excellent solution for the ones who live in cities and states of Brazil, where the air humidity is usually low in specific times of the year. For cities in which the air humidity is very high, the air conditioning appliance is not as efficient when compared to a region with a drier weather.

The air conditioning appliance may be used to substitute the air conditioning and the air humidifiers. Some more advanced models of air conditioning appliances also come with heating and ionizing resources.

There are basically two types of air conditioning appliances. The ones that are more common are the portable air conditioning appliances and we also have the wall air conditioning appliances, which are bigger and their installations looks like a standard air conditioning.

The air conditioning appliances are good alternatives for the air conditioning in cities where the humidity is low and they consume nine times less electrical energy than an air conditioning. The lower the humidity and higher the temperature, the higher is the capacity of the air conditioning appliance to reduce the temperature of the room from 5 to 10 degrees Celsius in relation to the outside temperature.

The known air conditioners use a water pump to pull the water from a reservoir and send it to the fan. This water reaches the fan and is atomized and spread in the room. This causes the temperature to go down due to the evaporation.

The documents mentioned in the patent are: BR 0.000.094-9; BR 0.104.775-2; BR 0.700.603-9; BR 8.602.976-2; BR 8.700.165-9; BR 8.800.202-0; BR 8.800.692-1; BR 8.801.015-5; BR 8.902.245-9; BR 8.900.950-9; BR 0.202.524-8.

Discussion

Therefore, thanks to the pertinent issues regarding the state of the art previously addressed, one of the aims of the present model of utility, the development of an air conditioning appliance that does not use a water pump to pull the water from the reservoir to the fan. In the systems that use the water pump it is common to face interruptions in its functioning, due to problems with abrasive particle solids, collected from the air and sent back to the reservoir. The pump pulls these solids that go through the movable parts and wear them out.

Another problem with the reservoirs is the return of non-atomized water. This water carries particle solids that end up being deposited in the reservoir. This forms a layer that is ideal for the development of fungi and bacteria, besides bad smell when the appliance has not been used for some time.

Thus, the solution proposed to eliminate the water reservoir and pump is to capture water to be atomized directly from the water supply network, transforming it integrally in mist. Therefore, there is no water left for contamination.

FIGURE DESCRIPTION

The characterization of the present application for patent of a utility model is done by means of a representative drawing of the construction disposition applied in an air conditioning appliance, in such a way that the equipment may be wholly reproduced by adequate technique, allowing a full characterization of the functionality of the object sought.

From the figure drawn, which expresses the best form or preferred form of the product idealized here, we base the foundations of the descriptive part of the report by means of a detailed and consecutive numbering, which explains aspects that might be unclear due to the chosen representation so as to clearly determine the protection here requested.

This figure is merely illustrative and may present some variation as long as they do not differ from what was initially requested.

In this case we have:

DESCRIPTION

Figure 1:
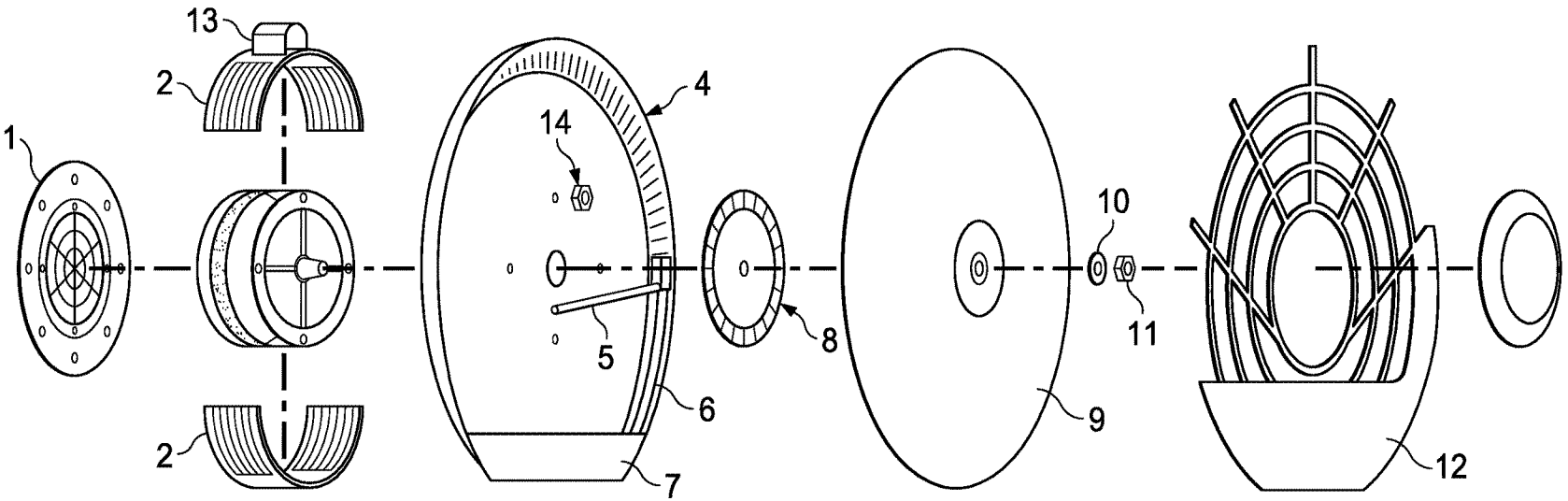
FIG. 1 illustrates an exploded view of the air conditioning appliance proposed.
Figure 2:
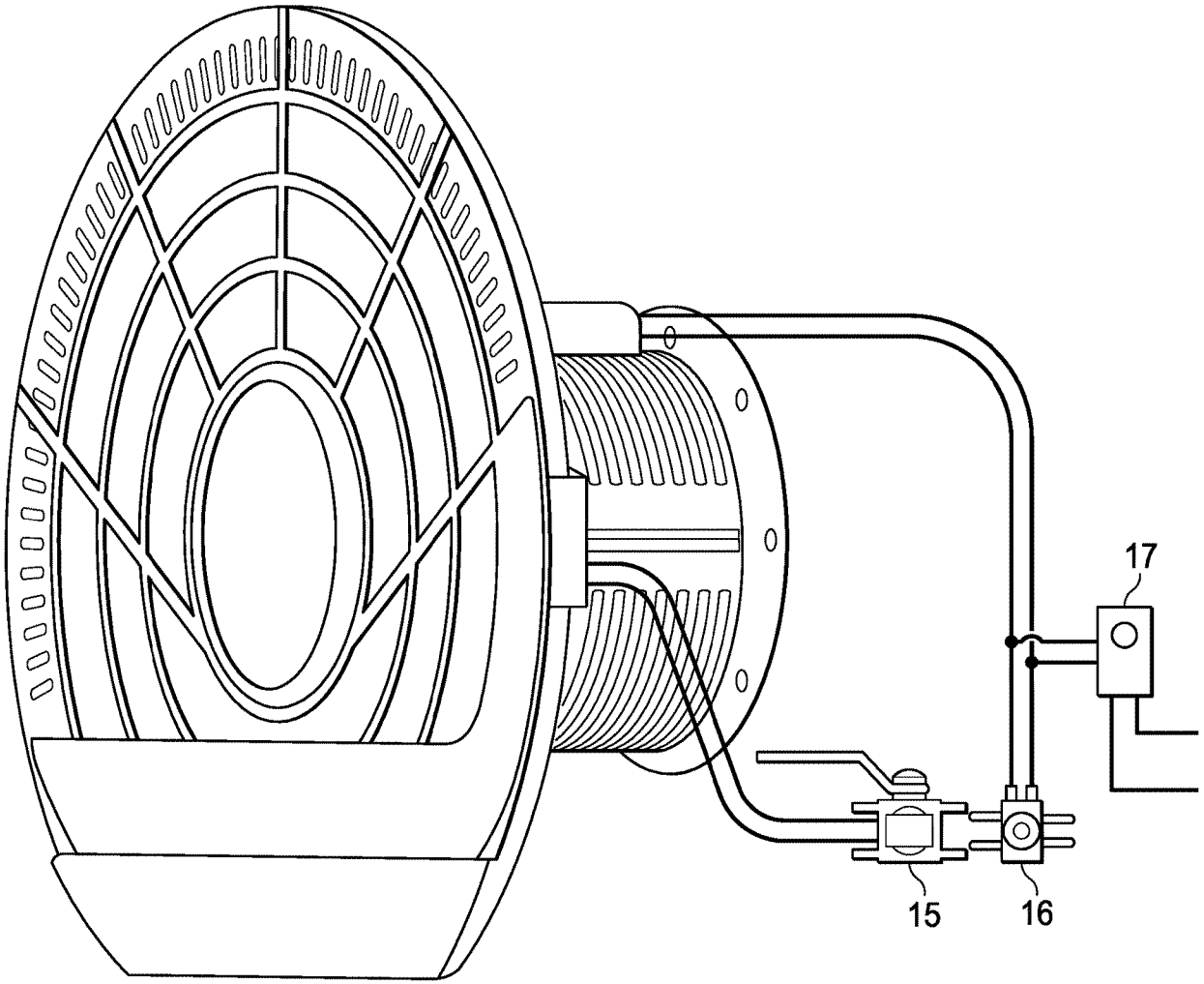
FIG. 2 shows the mounted air conditioning appliance.

An ideal form of producing the utility model comprehends a protection grid (1) placed in the back of the air conditioning appliance next to the engine (3), where the engine (3) is protected by a structure (2) that contains room for a starting device (13), being the latter an engine that is attached by terminal screws (14) to the tray (4). This tray (4) contains a number of radial ridges on its upper half and is completed by the main atomizer (9). The main atomizer (9) covers the pre-atomizer (8), and the water that supplies the pre-atomizer (8) comes from a main conduit (5), and this main conduit (5) is connected to a register (15) that is directly linked to the water supply network. A secondary conduit (6) that carries this water from the lower part to feed the pre-atomizer, in which there is a container (7) for this water in the lower part of the plate; including a pre-atomizer (8) that contains peripheral radial fins that allow the pre-atomization of water before sending it to the conic disc or main atomizer (9), in which this main atomizer (9) is attached to the shaft of the engine (3) by means of a mating nut (11) and washer (10) and contains a protection grid on its front part (12).

The register (15) is directly connected to an electrovalve (16), being this electrovalve (16) linked to the water network. When the air-conditioning appliance is started the electrovalve (16) opens the water that feeds it. When the air-conditioning appliance is turned off the electrovalve (16) closes the entrance of the water in the system. The amount of water that is sent to the pre-atomizer (8) is controlled by remote control (17).

Operation

The air-conditioning appliance proposed has two atomizing stages, in which the combination of these two stages produces an ultrafine water mist that allows for an improvement in the thermal exchange between the atomized water and the air in the environment.

The water goes into the air-conditioning appliance directly from the water network, goes through an electrovalve (16) and through a register (15). The electrovalve (16) controls the entrance or not of this water and the register (15) controls the amount of water. The water reaches the system by means of a main conduit (5), which comes from the piping of the register. This main conduit (5) takes the water directly to the pre-atomizer (8). Part of this water has already been pre-atomized and sent to the main atomizer (9) to produce an ultrafine mist, but a residue of water that is not immediately consumed in the pre-atomizer (8) remains. This water that is not consumed immediately is re-fed in the system by the main atomizer (9). The main atomizer when circling creates a flow of air that immediately carries the non-consumed water within a container (7) to a secondary conduit (6) placed in the internal side rim of the tray (4). The main atomizer (9) does not touch the existing water in the container (7), but just the flow of air and carries it to the aforementioned secondary conduit (6) and delivers it to a main conduit (5) that re-carries this water to the pre-atomizer (8). This pre-atomizer (8) fragments the water in droplets and carries it to a main atomizer (9) that transforms it in ultrafine mist. This way, all the water that enters the air-conditioning appliance is transformed into an ultrafine mist, without the need of a water and pump reservoir. When the air-conditioning appliance is turned off, all the residual water that may have remained in the main conduit (5), secondary conduit (6) and in the container (7) is consumed by the inertial rotation of the main atomizer (9).

The air-conditioning appliance must be associated to a fan, in which the flow of air created by the fan carries this ultrafine mist to the environment, allowing a thermal exchange of water-air, thus reducing the heat.

The invention claimed is:

1. An air conditioning appliance comprising:

an engine for powering the appliance;

a water source that provides water to the appliance;

a main atomizer for atomizing a portion of the water into mist, wherein the main atomizer is connected to the engine;

a tray that is located proximate to the main atomizer, wherein the tray has a number of radial ridges on a upper part of the tray and a container on a lower part of the tray that receives the portion of the water that is not atomized into mist;

a conduit for delivering the portion of the water that is not atomized into mist back to the main atomizer; and a fan that carries the mist into an environment.

2. The air conditioning appliance of claim 1, wherein the water source comprises a register that controls an amount of water in the flow.

3. The air conditioning appliance of claim 2, wherein the amount of the water that is sent to the main atomizer is controlled by a remote control.

4. The air conditioning appliance of claim 2, wherein the water source comprises an electrovalve that is located proximate to the register to control a flow of the water from the water source to the appliance.

5. The air conditioning appliance of claim 4, wherein when the appliance is started, the electrovalve opens to allow the flow of the water.

6. The air conditioning appliance of claim 4, wherein when the appliance is turned off, the electrovalve closes to stop the flow of the water.

7. The air conditioning appliance of claim 6, wherein when the air-conditioning appliance is turned off, a portion of the water remaining in the conduit and the container is consumed by an inertial rotation of the main atomizer.

8. The air conditioning appliance of claim 1, wherein the main atomizer comprises a pre-atomizer that fragments the water into droplets, wherein the droplets are provided to the main atomizer that transforms the droplets into the mist.

9. The air conditioning appliance of claim 8, wherein the pre-atomizer comprises a plurality of peripheral fins to fragment the water.

10. The air conditioning appliance of claim 8, wherein the main atomizer is operative to move water from the container to the pre-atomizer via the conduit.

11. The air conditioning appliance of claim 10, wherein the conduit comprises a first conduit that is connected between the pre-atomizer and the water source and a second conduit that is connected between the container and the first conduit.

12. The air conditioning appliance of claim 1, wherein the water source is a water network.

13. The air conditioning appliance of claim 1, wherein the water that is provided to the main atomizer is not returned to the water source.

* * * * *